US009267356B2

(12) United States Patent
Bell

(10) Patent No.: US 9,267,356 B2
(45) Date of Patent: Feb. 23, 2016

(54) SMART DOWNHOLE CONTROL

(75) Inventor: Robert Bell, Aberdeen (GB)

(73) Assignee: GE Oil & Gas UK Limited, Houston, TX (US)

( * ) Notice: Subject to any disclaimer, the term of this patent is extended or adjusted under 35 U.S.C. 154(b) by 704 days.

(21) Appl. No.: 13/590,792

(22) Filed: Aug. 21, 2012

(65) Prior Publication Data

US 2014/0054045 A1 Feb. 27, 2014

(51) Int. Cl.
*E21B 34/10* (2006.01)
*E21B 34/16* (2006.01)

(52) U.S. Cl.
CPC ..... *E21B 34/10* (2013.01); *E21B 34/16* (2013.01)

(58) Field of Classification Search
CPC ..... E21B 23/00; E21B 23/08; E21B 23/10; E21B 34/02; E21B 34/10; E21B 34/16
See application file for complete search history.

(56) References Cited

U.S. PATENT DOCUMENTS 4,051,894 A * 10/1977 Goad ..... 166/73
4,378,850 A 4/1983 Barrington
6,179,052 B1 1/2001 Purkis
6,470,970 B1 10/2002 Purkis et al.
6,575,237 B2 6/2003 Purkis
2003/0048197 A1 3/2003 Purkis et al.
2004/0050555 A1 3/2004 Rayssiguier et al.
2009/0065218 A1 3/2009 Loretz
2009/0295597 A1 12/2009 Grimseth

FOREIGN PATENT DOCUMENTS

GB 2335216 A * 9/1999 ..... E21B 34/10

OTHER PUBLICATIONS

International Search Report and Written Opinion issued in connection with corresponding Application No. PCT/EP2013/067337 on Oct. 16, 2014.

* cited by examiner

*Primary Examiner* — Cathleen Hutchins
(74) *Attorney, Agent, or Firm* — Bracewell & Giuliani LLP

(57) ABSTRACT

A downhole control system can include a pair of drive lines passing through a wellbore member such as a tubing hanger, and a plurality of hydraulic switches, each in communication with the drive lines. Each hydraulic switch can have a unique pressure band, wherein the switch only responds when the pressure in the drive lines is within the unique pressure band. Once the pressure in the drive lines is within the pressure band, the switch can open or close in response to a pressure differential in the drive lines.

16 Claims, 4 Drawing Sheets

SMART DOWNHOLE CONTROL

BACKGROUND OF THE INVENTION

1. Field of the Invention

The present invention relates in general to mineral recovery wells, and in particular to a control system for actuating hydraulic devices.

2. Brief Description of Related Art

Downhole devices are often used in a wellbore. Typical downhole devices can include, for example, flow control valves, hydraulic packers, and any variety of hydraulically actuated downhole tools. These downhole devices are typically controlled by hydraulic pressure, particularly because electronic controls cart be unreliable in high pressure, high temperature conditions that often exist in a wellbore. The hydraulic lines which control these downhole devices must pass through various well components such as, for example, tubing hangers. It can be difficult to pass a sufficient number of hydraulic lines through a tubing hanger, to control each and every downhole device.

Some systems exist which use Boolean logic to control multiple downhole devices from a relatively small number of lines. These systems can use, for example, multiple pulses of pressure to actuate a particular downhole device. Unfortunately, such Boolean systems can be unreliable.

SUMMARY OF THE INVENTION

Embodiments of a wellbore control system include a tubing hanger and a hydraulic fluid source. The hydraulic fluid source has a first output for outputting hydraulic fluid at a first drive line pressure and a second output for outputting hydraulic fluid at a second drive line pressure. A first drive line passes through the tubing hanger, the first drive line being in communication with the first output for communicating hydraulic fluid at the first drive line pressure. A second drive line passes through the tubing hanger, the second drive line being in communication with the second output for communicating hydraulic fluid at a second drive line pressure.

In embodiments, a first downhole control switch is connected to the first drive line and the second drive line. The first downhole control switch can move from a first position to a second position when each of the first drive line pressure and the second drive line pressure are within a first pressure band and the first drive line pressure exceeds the second drive line pressure by at least a first predetermined value.

In embodiments, a second downhole control switch is connected to the first drive line and the second drive line, the second downhole control switch moving from a first position to a second position when each of the first drive line pressure and the second drive line pressure are within a second pressure band and the first drive line pressure exceeds the second drive line pressure by at least a second predetermined value. In embodiments, a control line can be connected to each of the downhole control switches, each control line being operably connectable to a downhole device.

In embodiments, the second pressure band does not overlap the first pressure band. In embodiments, the first downhole control switch is not responsive to pressure differentials that occur outside of the first pressure band and the second downhole control switch is not responsive to pressure differentials that occur outside of the second pressure band.

Some embodiments can include a third downhole control switch connected to the first drive line and the second drive line, the third downhole control switch moving from a first position to a second position when each of the first drive line pressure and the second drive line pressure are within a third pressure band and the first drive line pressure exceeds the second drive line pressure by at least a third predetermined value. Some embodiments can include a fourth downhole control switch connected to the first drive line and the second drive line, the fourth downhole control switch moving from a first position to a second position when each of the first drive line pressure and the second drive line pressure are within a fourth pressure band and the first drive line pressure exceeds the second drive line pressure by at least a fourth predetermined value.

In embodiments, actuation of each of the first and second downhole control switches can latch the respective downhole control switch into an actionable state so that the respective downhole control switches are actuated in response to a pressure differential greater than a predetermined amount irrespective of the pressure band. In embodiments, each of the first and second downhole control switches that are latched in the actionable state are released from the actionable state when the first and second drive line pressures reach a predetermined latch release pressure, the predetermined latch release pressure being greater than the pressure bands corresponding to each of the downhole control switches.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

Figure 1:
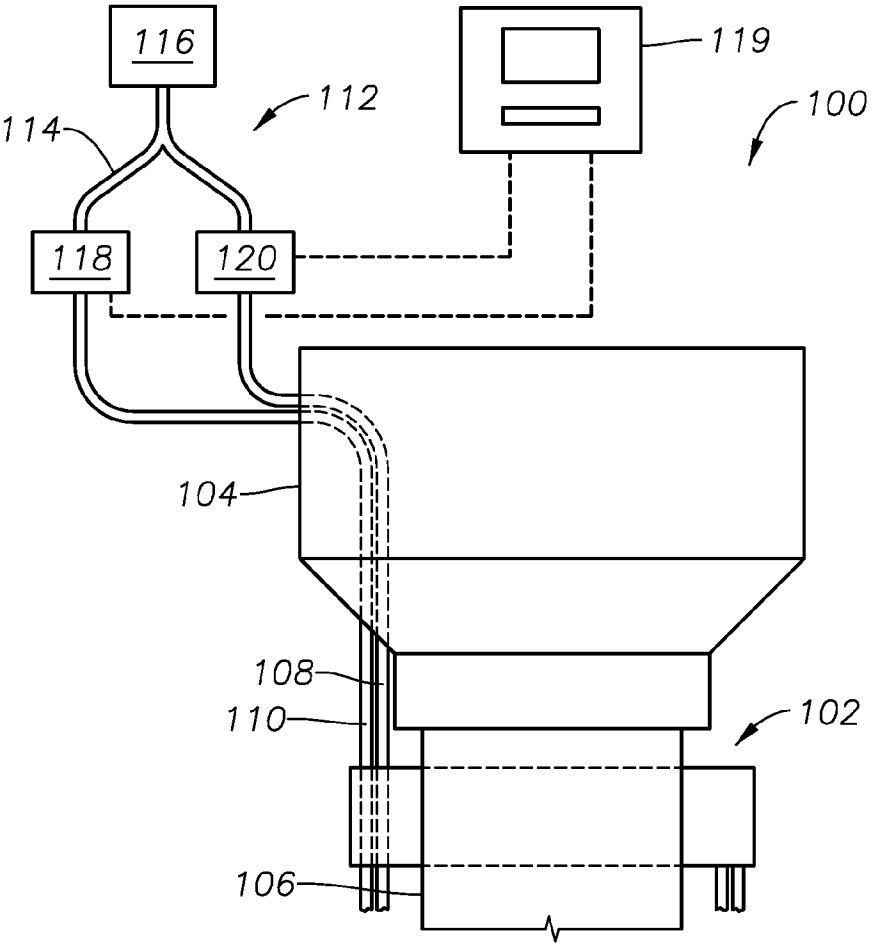
FIG. 1 is a partially sectional environmental view of an embodiment of a downhole control system.

Referring to FIG. 1, an example of a wellbore control system 100 is shown. The wellbore control system includes a control module 102, which is shown positioned below tubing hanger 104. Control module 102 can be mounted, for example, on a length of tubing 106, which can be suspended from tubing hanger 104. Tubing 106 can be any type of tubing including, for example, production tubing, a pup joint, or any other type of tubing. Alternatively, control module 102 can be connected to or otherwise suspended from tubing hanger 104.

Drive lines 108 and 110 can pass through passages within the body of tubing hanger 104, where the passages are shown curving from a generally lateral direction to a substantially axial direction in tubing hanger 104. Hydraulic fluid source 112 is located above tubing hanger 104. In embodiments, hydraulic fluid source 112 includes hydraulic lines 114 that are connected to, or connectable to, a discharge and return line of a hydraulic pump 116 or other pressurized hydraulic source. Controllers, such as control valves 118, 120, can control the flow and pressure of fluid through drive lines 108, 110 and from hydraulic fluid source 112. An operator or other control mechanism, such as a controller 119, can actuate control valves 118, 120 to selectively pressurize drive lines 108, 110. As one of ordinary skill will appreciate, controller 119 can include, for example, a computer, microprocessor, or other devices to enable an operator to actuate control valves 118, 120.

Figure 2:
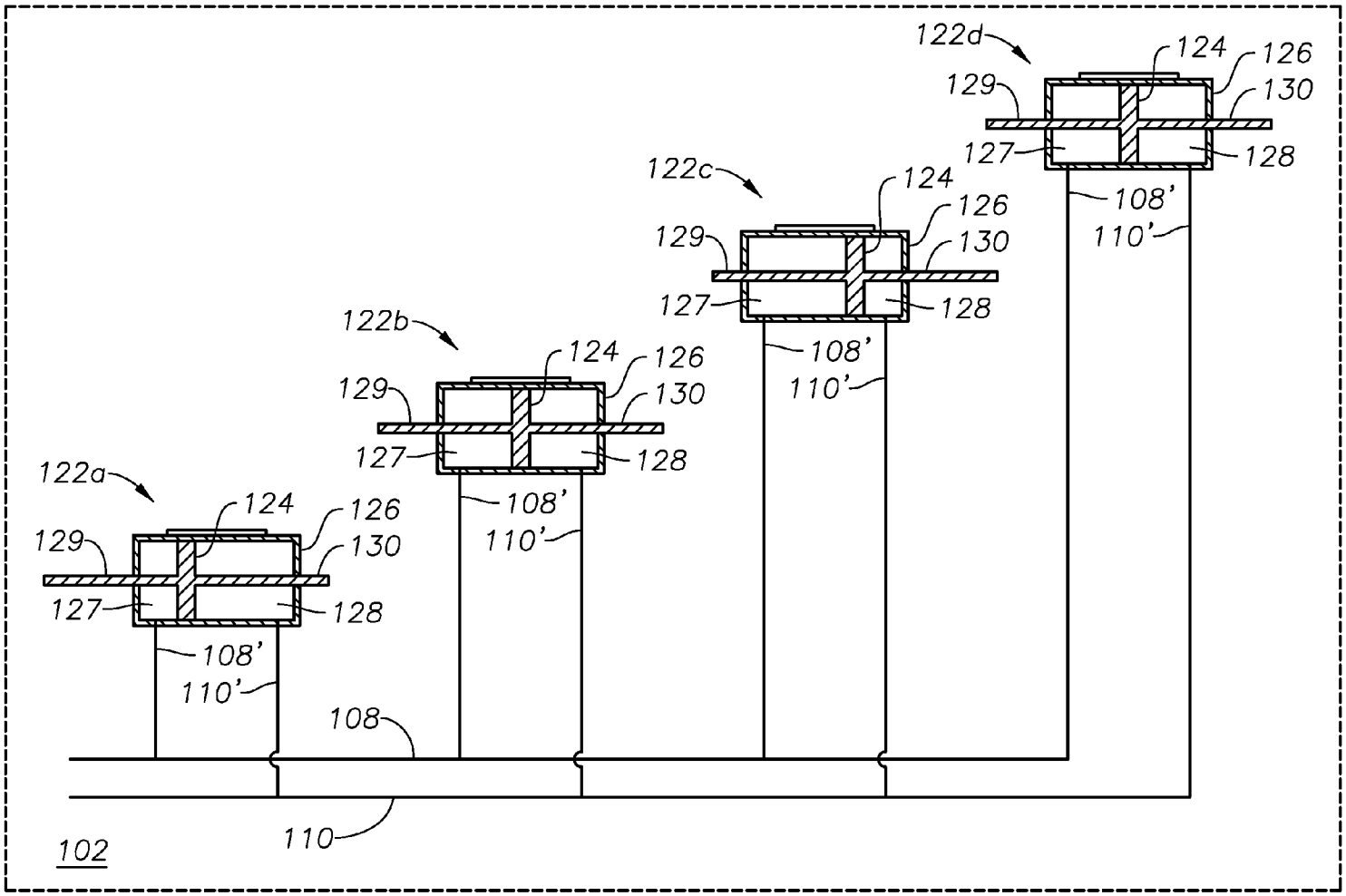
FIG. 2 is a partially sectional environmental view of a control module of the downhole control system of FIG. 1.

Referring to FIGS. 1 and 2, drive lines 108, 110 are connected to switches 122*a-d*. While four switches 122*a-d* are shown, drive lines 108, 110 can be connected to any number of switches. In embodiments, some or all of switches 122*a-d* can be located within control module 102 housing. Hydraulic pressure from drive lines 108, 110 are simultaneously communicated to each of switches 122*a-d* by, for example, direct lines 108' and 110', as shown in FIG. 2, or by, for example, one or more manifolds (not shown) or other distribution devices. In embodiments, the same pressure is communicated to each of switches 122*a-d*, but switches 122*a-d* can each respond to different pressures or different pressure differentials.

In embodiments, each switch 122*a-d* include a piston 124 axially slideable within a cylinder in switch body 126 in response to a pressure differential on opposing sides of piston 124. Cavity 127 is the volume within switch body 126 that is in communication with direct line 108' and thus, has a pressure generally equal to that of drive line 108. Cavity 128 is the volume within switch body 126 that is in communication with direct line 110' and, thus, has a pressure generally equal to that of drive line 110. Piston 124 separates cavity 127 from cavity 128. Piston 124 can move in a first direction (for example, toward line 108' when looking at FIGS. 2 and 3) in response to pressure in lines 110, 110', and thus cavity 128, being greater than pressure in drive line 108. Similarly, piston 124 can move in a second direction (for example, toward line 110' when looking at FIGS. 2 and 3) in response to pressure in lines 108, 108', and thus cavity 127, being greater than the pressure in drive line 110. The components of each switch 122*a-d*, such as piston 124, body 126, and cavity 128, can each be the same or can be of different sizes, materials, and configurations depending on, for example, the device to be actuated by each switch 122*a-d*.

Actuators 129, 130, which can be rods, are connected to either side of piston 124 so that when piston 124 moves in a first direction, actuator 129 extends in the same direction and actuator 130 is withdrawn in the same direction. Conversely, when piston 124 moves in a second direction, actuator 129 is withdrawn in the second direction and actuator 130 extends in the second direction.

Figure 3:
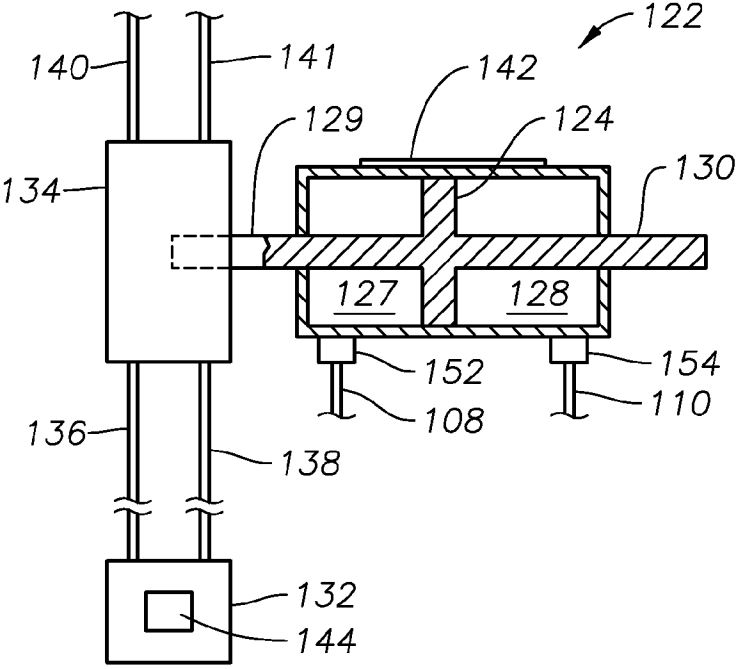
FIG. 3 is a partially sectional side view of a switch, valve, and downhole device of the downhole control system of FIG. 1.

Referring now to FIG. 3, each switch 122*a-d* controls a unique downhole device 132. Downhole devices 132 can include, for example, sleeve-type control valves, hydraulic packers, and other downhole tools. As one of ordinary skill in the art will appreciate, any variety of hydraulically actuated downhole devices can be used. In embodiments, hydraulic valve 134 is connected to actuator 129 or actuator 130. Hydraulic valve 134 can be opened or closed in response to movement of actuator 129 or actuator 130. When actuator 129 moves in a first direction, for example, it opens hydraulic valve 134, and when actuator 129 moves in the opposite direction, it closes hydraulic valve 134. The differential pressure induced at a specific activation level provides the impetus for the action of the device and governs the direction of movement. This direction can be reversed by changing the differential from a positive to a negative value.

Downhole control lines 136, 138 can lead to any of a variety of downhole devices, each being actuated by pressure or a pressure differential within the downhole control lines 136, 138. In embodiments, each switch 122*a-d* controls one hydraulic valve 134 and each hydraulic valve 134 controls one downhole device 132. In embodiments, the number of downhole devices 132 that can be independently controlled is equal to the number of switches 122. In some embodiments, not all switches 122*a-d* are used. In some embodiments, multiple downhole devices 132 are controlled by a single hydraulic valve 134, in which case each of the multiple downhole devices 132 is actuated at the same time in response to the opening or closing of hydraulic valve 134. Supply lines 140 and 141 can be a supply and return line that supply hydraulic fluid to hydraulic valves 134. Supply lines 140, 141 can be connected to, for example, drive lines 108, 110, or supply lines 140, 141 can be connected to another hydraulic fluid source (not shown).

In some embodiments, one or more downhole devices 132 are operated by a ratchet mechanism. In such "ratcheting devices," an actuation of switch 122, and thus downhole control lines 136, 138, provides only a small movement of downhole device 132. A series of such small movements, each causing a member of the ratcheting device to incrementally advance, is required to operate a ratcheting device. In embodiments, each pressure differential in control lines 136, 138, resulting from each actuation of switch 122, can incrementally advance downhole device 132. In other words, multiple actions are needed to enact the movement required by the user.

In embodiments, a sensor 142 is connected to switch 122*a-d* for determining the position of piston 124 and, thus, the position of switch 122. Sensor 142 can be any type of sensor including, for example, electrical, fiber-optic, or magnetic. In embodiments, the system can be twinned with a separate (similar) unit giving hydraulic feedback for the position of the function. In embodiments, sensor 144 can be connected to downhole device 132. Sensor 144 can be any type of sensor including, for example, electrical, fiber-optic, or magnetic. Sensor 144 can determine the state or position of the downhole device 132. Sensor 144 can send a signal to a computer such as, for example, controller 119, regarding the state or position of downhole device 132 and, thus, controller 119 or an operator can use that signal data to determine when an action is complete or an intermediary position is in requirement of a cessation of action.

Switches 122*a-d* are operated by pressure differentials, and are limited to actuate only within a specific band of pressure. When the pressure in cavities 127 and 128 is equalized, piston 124 is held neutral and, thus, remains stationary. If the pressures in cavities 127 and 128 are increased or decreased together, by the same amount, there is no action by piston 124. Wellbore control system 100, thus, is an analog control system that, in embodiments uses a pair of pressure sources to trigger action in an analog manner.

Figure 4:
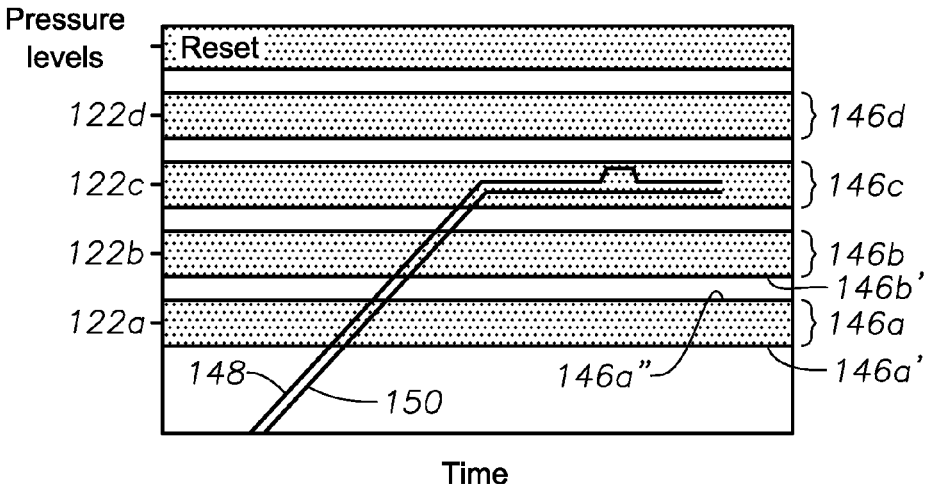
FIG. 4 is an exemplary pressure chart of the downhole control system of FIG. 1 showing a switch that opens in response to a pressure increase in a pressure line.

Referring to FIG. 4, pressure bands 146*a-d* correspond to switches 122*a-d*, respectively. Graph lines 148 and 150 are graph lines representing the pressure within drive lines 108, 110 and, for simplicity of explanation, are referred to as pressures 148 and 150. Each switch is in an actionable state only when pressures 148, 150, are within the pressure band 146*a-d* corresponding to that switch. For example, switch 122*a* is in an actionable state, and thus can only be actuated, when pressure 148, 150, in drive lines 108, 110, respectively, is within pressure band 146*a*. When pressures 148 and 150 are each greater than pressure 146*a*' and less than 146*a*", the operator can create a pressure differential between pressure 148 and pressure 150, and thus across piston 124 of switch 122*a*, which causes switch 122*a* to actuate. For example, in embodiments, the operator can close control valve 118 (FIG. 1) while leaving control valve 120 (FIG. 1) open, and increase the pressure in hydraulic line 114 (FIG. 1). This condition will cause a greater pressure in cavity 128 than in cavity 127, thus actuating piston 124. Pressure bands 146*b-d*, corresponding to switches 122*b-d*, respectively, are different than pressure band 146*a*. Because pressures 148 and 150 are not within pressure bands 146*b-d* (in this case, pressure bands 146*b-d* each exceed pressure band 146*a*), none of switches 122*b-d* respond to the pressure differential that actuates switch 122*a*. In this example, switch 122*a* is said to be the active device because switch 122*a* is the only switch that can be actuated.

Pressure bands 146*a-d* can be any pressure. In embodiments, pressure bands 146*a-d* do not overlap and, in some embodiments, a gap exists between the upper pressure 146*a*" of one band 146 and the lower pressure 146*b*' of the next pressure band. For example, pressure bands 146 can have the pressure ranges shown in Table 1:

TABLE 1

| Pressure Band | Center Point of Pressure Band (psi) | Range of Pressure Band (psi) |
|---|---|---|
| 146a | 2500 | 2400-2600 |
| 146b | 3000 | 2900-3100 |
| 146c | 3500 | 3400-3600 |
| 146d | 4000 | 3900-4000 |

In embodiments, control valves 152, 154 (FIG. 3) which can be, for example, spring-loaded valves, are used between direct lines 108', 110' and cavities 127, 128. The control valves 152, 154 can each be used to establish the actionable state corresponding to a particular pressure band 146. For example, such valves open when pressure 148, 150 reaches the lower end of pressure band 146, pressure 146', and close if the pressure goes above the upper end of pressure band 146, pressure 146', or falls below 146'. Therefore, pressures 148 and 150 can be simultaneously increased until reaching another pressure band and, during the increase, not actuate switches 122*a-d* in the pressure bands 146 through which the pressures 148, 150 pass, as long as the pressure differential in lines 108, 110 remains sufficiently small. As shown in FIG. 4, pressures 148 and 150 are increased until both are within pressure band 146*c*, which corresponds to switch 122*c*. During the pressure increase, or ramp, in the example shown in FIG. 4, switches 122*a* and 122*b* are not actuated because there is insufficient differential pressure between pressure 148 and pressure 150 as the pressures pass through pressure bands 146*a* and 146*b*. Once pressures 148 and 150 are within pressure band 146*c*, pressure 148 can be increased, relative to pressure 150, thus actuating switch 122*c*.

Figure 5:
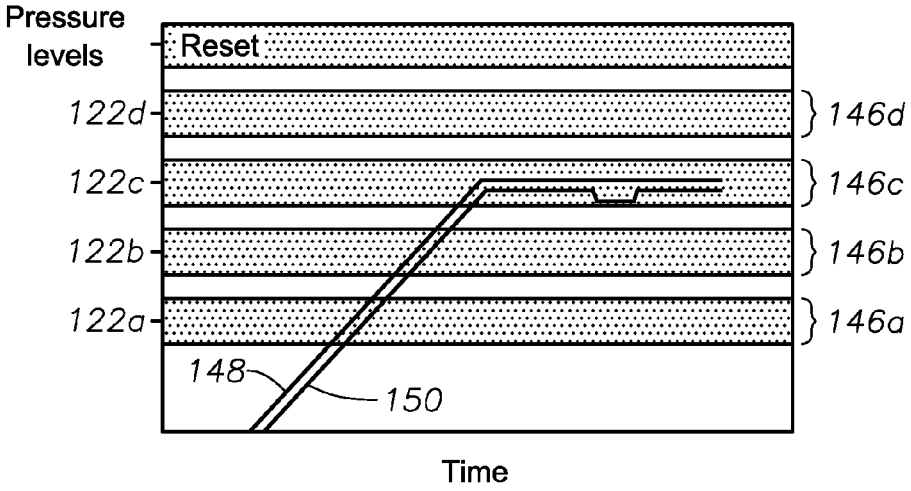
FIG. 5 is an exemplary pressure chart of the downhole control system of FIG. 1 showing a switch that opens in response to a pressure decrease in a pressure line.

In various embodiments, switches 122*a-d* can be actuated by being "opened up" or "opened down." A switch 122*a-d* that is opened up is actuated when one pressure 148, 150 is increased relative to the other pressure 148, 150, as illustrated in FIG. 4. Referring now to FIG. 5, in embodiments that are opened down, each switch 122*a-d* can be actuated when one pressure 148, 150 is decreased relative to the other pressure 148, 150, provided that the pressures 148, 150 are within the appropriate pressure band 146. As shown by the exemplary embodiments, wellbore control system 100 has an absence of pulsed pressures. Embodiments of wellbore control system 100, thus, are actuated by analog controls and have an absence of Boolean logic.

Figure 6:
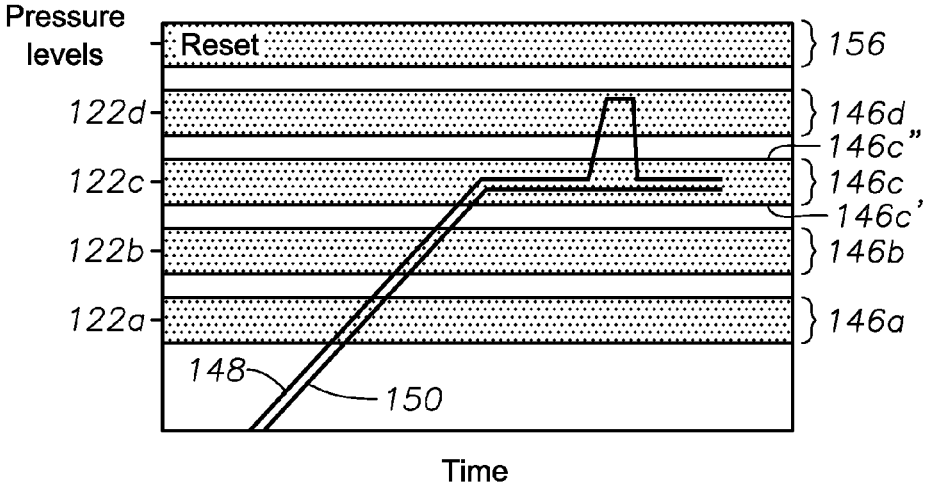
FIG. 6 is an exemplary pressure chart of the downhole control system of FIG. 1 showing a switch that opens in response to a pressure increase, in a pressure line, that exceeds the pressure band.

Referring now to FIG. 6, in embodiments, each switch 122*a-d* can be latched into an actionable state. When both pressures of lines 108, 110 are within the corresponding pressure band, the control valves can latch open and the switch can remain in an actionable state so long as one of the pressures remains within the pressure band. The other pressure can be increased or decreased to create a pressure differential, and thus actuate the switch, even if that other pressure goes above or below the bounds of the pressure band. In the example shown in FIG. 6, control valves 152*c*, 154*c* (FIG. 3) are latched open when pressures 148, 150 reach pressure band 146*c*. As long as one of the pressures 148, 150 remains within pressure band 146*c*, the other pressure 148, 150 can go above pressure 146*c*" or below pressure 146*c*' without unlatching switch 122*c*. Therefore, switch 122*c* can be actuated by a pressure differential that results in one of the pressures 148, 150 going outside of the pressure band.

In some embodiments, switches 122*a-d* or control valves 152, 154 are reset when pressures 148, 150 are set to a "reset pressure" 156. Reset pressure 156 can be, for example, a pressure that is greater than any of the pressure bands 146. Alternatively, reset pressure 156 can be less than any of the pressure bands 146. Reset pressure 156 can cause, for example, any latched control valves 152, 154 to unlatch. In embodiments, reaching reset pressure 156 causes any latched switches 122*a-d* to unlatch.

Switch 122*a-d* can be in a live state in which the position of piston 124*a-d* is totally dependent on the pressures provided through control lines 108, 110. Conversely piston 124*a-d* may include the use of a latch (not shown) to fix piston 124 at the working position for the duration of activity on the chosen downhole device 132. By such methods, the downhole device 132 (FIG. 3) being controlled can obtain any pressure for action providing the other pressure source is maintained within the pressure band specified for that switch 122. This can be used to operate complex devices such as a ratchet or a hydraulic motor with no action on the downhole devices 132 not selected for operation. At the end of the operation period the latch can be released using a reset pressure that is higher than any of the device operating values.

In an example of a system using latching valve technology, pressures 148, 150 can be set in the pressure band 146*c*, which is the pressure band for the exemplary switch 122*c*. The center point of pressure band 146*c* can be, for example, 4000 psi. Switch 122*c* can be actuated in one direction by, for example, increasing pressure 150 to 4500 psi. The control valves 152, 154 latch into the open position so that a differential between pressure 148 and pressure 150 will actuate switch 122*c*. Pressure 150 can be reduced to 3500 psi, while pressure 148 remains at 4000 psi, to actuate switch 122*c*. In embodiments, control valves 152, 154 remains open, and thus switch 122*c* remains actionable in response to a pressure differential, until control valves 152, 154 are reset. Control valves 152, 154 are reset by, for example, increasing pressures 148, 150 to the reset pressure. That reset pressure can be, for example, 10,000 psi.

In embodiments, an absence of Boolean logic is used to control multiple downhole devices from as few as two drive lines 108, 110. In embodiments, when the pressures in drive lines 108, 110 are the same, no action is undertaken by any switches 122. When the pressures in drive lines 108, 110 diverge, the pressure point at which the divergence begins is the identifier of the switch, and thus the downhole device, which will be actuated.

Figure 7:
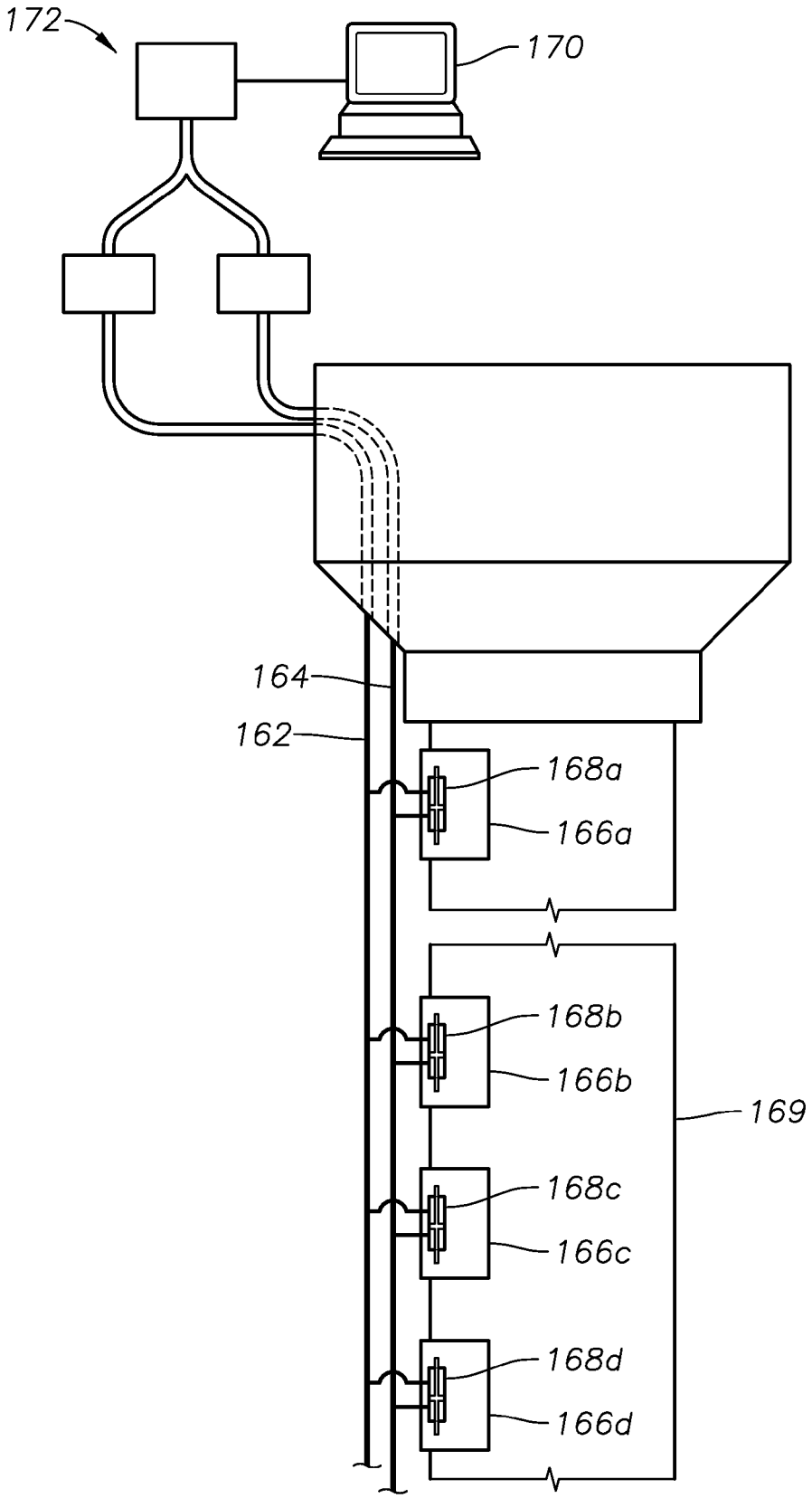
FIG. 7 is a partially sectional environmental view of an embodiment of a downhole control system having switches located proximate to downhole devices.

Referring to FIG. 7, in some embodiments, the control module can include components that are positioned in different locations within the wellbore. For example, drive lines 162, 164 can extend to each downhole device 166*a-d*. A switch 168*a-d* can be located within the housing of, or proximate to, each downhole device 166*a-d*. In embodiments, switches 168*a-d* can be spaced apart along tubing 169 and connected to each downhole device 166*a-d*. Switches 168*a-d* can be mounted upon, near, or spaced apart from each downhole device 166*a-d*. An operator can operate controller 170 to control hydraulic source 172, thus controlling the pressure within drive lines 162, 164.

As with other embodiments described herein, each switch 168*a-d* can respond to a pressure differential, provided that the pressures of drive lines 162, 164 are each within a pressure band corresponding to the respective switch 168*a-d*. In embodiments, one or more of switches 168*a-d* can be latched into an actionable state when, for example, the pressure of drive lines 162, 164 are within the appropriate pressure band and the particular switch 168*a-d* is actuated. Once latched into an actionable state, the particular switch 168*a-d* can be actuated by a pressure differential even if the pressure in one of the drive lines 162, 164 is outside of the appropriate pressure band. In embodiments, once latched into an actionable state, switches 168*a-d* can be actuated even if pressures of both drive lines 162, 164 are outside of the appropriate pressure band. In embodiments, pressures of drive lines 162, 164 can be increased to a reset pressure, the reset pressure unlatching all latched switches 168*a-d*.

While the invention has been shown or described in only some of its forms, it should be apparent to those skilled in the art that it is not so limited, but is susceptible to various changes without departing from the scope of the invention.

What is claimed is:

1. A method for actuating a plurality of wellbore devices, the method comprising:

(a) providing a hydraulic fluid source, the hydraulic fluid source having a first output for outputting hydraulic fluid at a first drive line pressure and a second output for outputting hydraulic fluid at a second drive line pressure, the pressure differential between the first drive line pressure and the second drive line pressure defining a drive line pressure differential;

(b) providing a first drive line and a second drive line, each drive line passing through a tubing hanger, the first drive line being in communication with the first output and the second drive line being in communication with the second output;

(c) connecting a first downhole control switch to the first drive line and the second drive line, the first downhole control switch moving from a first switch first position to a first switch second position when each of the first drive line pressure and the second drive line pressure are within a first pressure band and the drive line pressure differential exceeds a first predetermined value;

(d) connecting a second downhole control switch to the first drive line and the second drive line, the second downhole control switch moving from a second switch first position to a second switch second position when each of the first drive line pressure and the second drive line pressure are within a second pressure band and the drive line pressure differential exceeds a second predetermined value, and wherein the first pressure band does not overlap with the second pressure band so the second downhole control switch is not actuated in the step of actuating the first downhole control switch;

(e) connecting a pair of hydraulic control lines to each of the first and second downhole control switches, each pair of hydraulic control lines transmitting a hydraulic pressure in response to the first downhole control switch being in the first switch first or second position, or the second control switch being in the second switch first or second position;

(f) increasing the first drive line pressure and the second drive line pressure while keeping the drive line pressure differential below the first predetermined value until the first and second drive line pressures are within the first pressure band; and (g) actuating the first downhole control switch by increasing the drive line pressure differential to greater than the first predetermined value.

2. The method according to claim 1, further comprising the steps of:

returning the drive line pressure differential to less than the first predetermined value;

increasing the first drive line pressure and the second drive line pressure, while keeping the drive line pressure differential below the second predetermined value, until the first and second drive line pressures are within the second pressure band; and actuating the second downhole control switch by increasing the drive line pressure differential to greater than the second predetermined value.

3. The method according to claim 2, wherein the step of returning the drive line pressure differential to less than the first predetermined value deactivates the first downhole control switch.

4. The method according to claim 2, wherein the step of actuating the first downhole control switch causes the first downhole control switch to latch into an actionable state, and wherein the step of increasing the drive line pressure differential to greater than the second predetermined value, while the first and second drive line pressures are within the second pressure band, actuates the first downhole control switch when the first downhole control switch is in the actionable state.

5. The method according to claim 4, further comprising the step of unlatching the first downhole control switch by increasing the first and second drive line pressures to greater than a predetermined unlatch pressure, the predetermined unlatch pressure being greater than the pressure of the first and second pressure bands.

6. A method for actuating a plurality of wellbore devices, the method comprising:

(a) providing a hydraulic fluid source, the hydraulic fluid source having a first output for outputting hydraulic fluid at a first drive line pressure and a second output for outputting hydraulic fluid at a second drive line pressure, the pressure differential between the first drive line pressure and the second drive line pressure defining a drive line pressure differential;

(b) providing a first drive line and a second drive line, each drive line passing through a tubing hanger, the first drive line being in communication with the first output and the second drive line being in communication with the second output;

(c) connecting a plurality of downhole control switches to the first drive line and the second drive line, each of the plurality of downhole control switches moving from a first position to a second position when the first drive line pressure and the second drive line pressure are within a unique pressure band corresponding to each of the respective plurality of downhole control switches and the drive line pressure differential exceeds a respective predetermined value, wherein the pressure bands corresponding to each of the plurality of downhole control switches do not overlap;

(d) connecting one of a plurality of control lines from each of the plurality of downhole control switches to one of a plurality of downhole devices;

(e) increasing the first drive line pressure and the second drive line pressure, while keeping the drive line pressure differential below each of the predetermined values until the first and second drive line pressures are within a pressure band corresponding to a first one of the plurality of downhole control switches; and (f) actuating a first one of the downhole control switches by increasing the drive line pressure differential to greater than the respective predetermined value for the first one of the downhole control switches, the actuation of the first one of the downhole control switches causing actuation of the downhole device connected thereto by one of the control lines.

7. The method according to claim 6, further comprising the steps of:

returning the drive line pressure differential to less than the respective predetermined value for the first one of the downhole control switches;

increasing the first drive line pressure and the second drive line pressure, while keeping the drive line pressure differential below the each of the respective predetermined values, until the first and second drive line pressures are within a pressure band corresponding to a second one of the plurality of downhole control switches; and actuating the second one of the plurality of downhole control switches by increasing the drive line pressure differential to greater than the predetermined value for the second one of the plurality of downhole control switches.

8. The method according to claim 7, wherein the step of returning the drive line pressure differential to less than the predetermined value for the first one of the plurality of control switches deactivates the first one of the plurality of control switches.

9. The method according to claim 6, wherein one or more of the plurality of downhole control switches are latched into an actionable state when actuated, and wherein the step of increasing the drive line pressure differential to greater than the respective predetermined value actuates each of the plurality of downhole control switches that are in the actionable state.

10. The method according to claim 9, further comprising the step of unlatching each of the plurality of downhole control switches that are in the actionable state by increasing the first and second drive line pressures to greater than a predetermined unlatch pressure.

11. A wellbore control system for actuating a plurality of wellbore devices for a wellhead having a tubing hanger, comprising:

a hydraulic fluid source having a first output and a second output;

a first drive line passing through the tubing hanger and in communication with the first output of the hydraulic fluid source;

a second drive line passing through the tubing hanger and in communication with the second output of the hydraulic fluid source;

a first downhole control switch in fluid communication with the first drive line and the second drive line, the first downhole control switch moving from a first switch first position to a first switch second position when each of a pressure of the first drive line and a pressure of the second drive line are within a first pressure band and the first drive line pressure exceeds the second drive line pressure by at least a first predetermined value;

a second downhole control switch connected to the first drive line and the second drive line, the second downhole control switch moving from a second swiitch first position to a second switch, second position when each of the pressure of the first drive line and the pressure of the second drive line are within a second pressure band and the pressure of the first drive line exceeds the pressure of the second drive line by at least a second predetermined value, wherein values of the second pressure band are different from values of the first pressure band; and a separate control line connected to each of the downhole control switches, the control line being operably connectable to a downhole device.

12. The system according to claim 11, wherein the first downhole control switch is dormant when the difference between the pressure of the first drive line and the pressure of the second drive line, defining a pressure differential, occurs outside of the first pressure band and the second downhole control switch is dormant when the pressure differential occurs outside of the second pressure band.

13. The system according to claim 11, further comprising a third downhole control switch connected to the first drive line and the second drive line, the third downhole control switch moving from a third switch first position to a third switch second position when each of the pressure of the first drive line and the pressure of the second drive line are within a third pressure band and the first drive line pressure exceeds the second drive line pressure by at least a third predetermined value; and a fourth downhole control switch connected to the first drive line and the second drive line, the fourth downhole control switch moving from a fourth switch first position to a fourth switch second position when each of the pressure of the first drive line and the pressure of the second drive line are within a fourth pressure band and the first drive line pressure exceeds the second drive line pressure by at least a fourth predetermined value.

14. The system according to claim 11, wherein actuation of each of the first and second downhole control switches latches the respective downhole control switch into an actionable state wherein the respective downhole control switches are actuated in response to a pressure differential greater than a predetermined amount irrespective of either the first or second pressure bands.

15. The system according to claim 14, wherein each of the first and second downhole control switches that are latched in the actionable state are released from the actionable state when the pressure of each of the first and second drive lines reach a predetermined latch release pressure, the predetermined latch release pressure being greater than the pressure bands corresponding to each of the downhole control switches.

16. The system according to claim 11, wherein the hydraulic fluid source comprises a first control valve for outputting hydraulic fluid at the first drive line pressure and a second control valve for outputting hydraulic fluid at the second drive line pressure.

* * * * *